United States Patent [19]

Schanz et al.

[11] Patent Number: 4,511,085

[45] Date of Patent: Apr. 16, 1985

[54] SWIVEL DRIVE FOR FAN-JET SPRINKLER

[75] Inventors: Friedrich Schanz; Emil Schucker; Eberhard Schucker, all of Calw; Alexander Perrot, Althengstett, all of Fed. Rep. of Germany

[73] Assignee: Perrot-Regnerbau GmbH & Co., Calw, Fed. Rep. of Germany

[21] Appl. No.: 366,678

[22] Filed: Apr. 8, 1982

[30] Foreign Application Priority Data

Apr. 8, 1981 [DE] Fed. Rep. of Germany ..... 3114095

[51] Int. Cl.[3] ..... B05B 3/16

[52] U.S. Cl. ..... 239/242; 74/54

[58] Field of Search ..... 74/54; 239/240, 241, 239/242, 260–263

[56] References Cited

U.S. PATENT DOCUMENTS

| | | | |
|---|---|---|---|
| 578,269 | 3/1897 | Savorgnan | 74/54 |
| 2,898,770 | 8/1959 | Van Hook | 74/54 |
| 3,394,601 | 7/1968 | Waldenburger | 74/54 |
| 4,199,995 | 4/1980 | Murakami | 74/54 |
| 4,245,786 | 1/1981 | Abrahamsen et al. | 239/242 |

*Primary Examiner*—Jeffrey V. Nase
*Assistant Examiner*—Jon M. Rastello
*Attorney, Agent, or Firm*—Joseph A. Geiger

[57] ABSTRACT

A drive mechanism for a swiveling fan-jet sprinkler comprising a water-driven turbine, a reduction gear drive and, on the final drive shaft of the latter, a rotary cam member cooperating with a cam follower on the nozzle cylinder. The rotary cam member is preferably a swash plate with an elliptical torus-like rim, engaged by a fork-shaped cam follower. The mechanism may include adjustability of the swivel angle of the nozzle cylinder through a swash plate with an adjustable inclination on the final drive shaft.

9 Claims, 11 Drawing Figures

Fig. 1
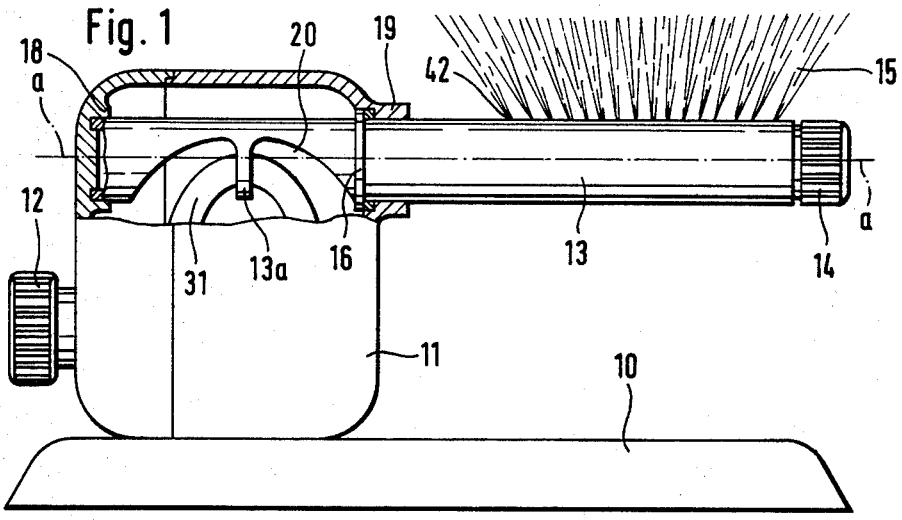
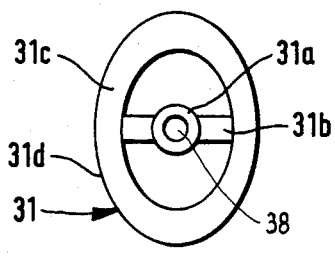
Fig. 2
Fig. 3
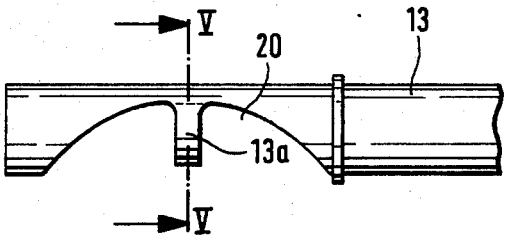
Fig. 4
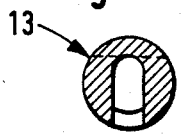

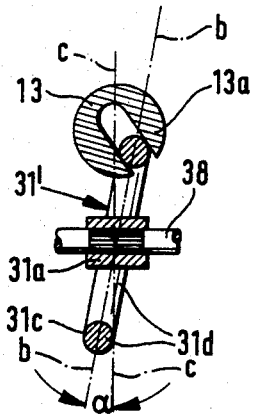
Fig. 5
Fig. 6
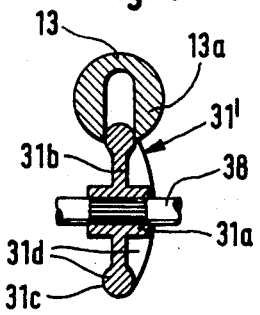
Fig. 7
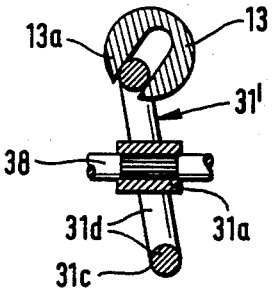
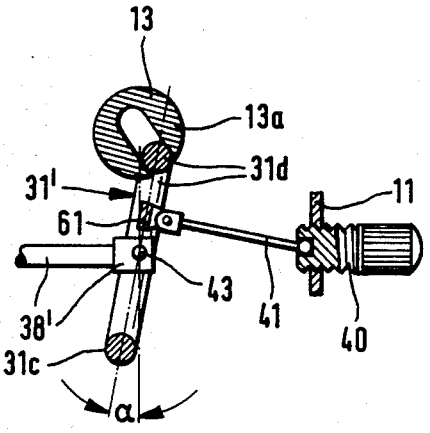
Fig. 8
Fig. 8a
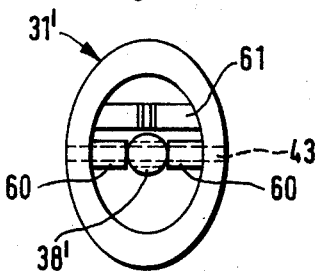

SWIVEL DRIVE FOR FAN-JET SPRINKLER

BACKGROUND OF THE INVENTION

1. Field of the Invention

The present invention relates to irrigation sprinklers and, more particularly, to a swiveling fan-jet sprinkler of the type which has a slowly oscillating horizontal nozzle cylinder with a row of jet nozzles arranged in a fan-tail pattern, and which uses a water-driven turbine to produce the swiveling movement of the nozzle cylinder.

2. Description of the Prior Art

Swiveling sprinklers of the type under consideration are known from the prior art. They are commonly used for the watering of lawns or for the irrigation of vegetable and flower beds, having the advantageous capability of covering an area of generally square or rectangular outline.

It is also known that the swiveling movement of the nozzle cylinder can be derived from the kinetic energy of the flowing water by utilizing the latter to drive a small turbine which, through the intermediary of a reduction gear and crank drive, produces the desired swiveling motion of the nozzle cylinder about its own axis. Such a device is disclosed in U.S. Pat. No. 3,647,140. The prior art device has the shortcoming of necessitating a considerable number of component parts for the reduction gear and crank drive. A second shortcoming is related to the limitations of such a crank drive in terms of the adjustability of the total angle covered by the swiveling motion.

SUMMARY OF THE INVENTION

Underlying the present invention is the primary objective of proposing an improved drive mechanism for a swiveling fan jet sprinkler which is simpler in design and therefore less expensive and which, additionally, offers a convenient means for adjusting the swivel angle of the nozzle cylinder.

The present invention proposes to attain this objective by suggesting an improved drive mechanism for a swiveling fan jet sprinkler which has a turbine and, as part of a reduction gear drive, a final drive shaft arranged transversely to the axis of the nozzle cylinder. The final drive shaft carries a rotary cam member in median alignment with an axial plane through the nozzle cylinder, and the nozzle cylinder carries a cam follower cooperating with the rotary cam member to produce the desired swiveling motion.

In a preferred embodiment of the invention, the rotary cam member is a swash plate with a generally elliptical torus-like rim, and the nozzle cylinder carries a fork-shaped cam follower which engages the torus rim from opposite sides. Alternatively, the swash plate may have a radially open groove engaging a follower with appropriately rounded oppositely oriented flanks.

By way of a further improvement, the present invention suggests a simple mechanism for adjusting the total angle over which the nozzle cylinder is rotated, by adjusting the inclination of the swash plate in relation to the axis of the final drive shaft.

In a modification of the preferred embodiment, the rotary cam member may be a cam cylinder with a sinusoidal groove which is engaged by a cam follower with rounded or spherical drive surfaces.

The cam follower on the nozzle cylinder is preferably an integral part of the nozzle cylinder itself.

BRIEF DESCRIPTION OF THE DRAWINGS

Further special features and advantages of the invention will become apparent from the description following below, when taken together with the accompanying drawings which illustrate, by way of example, embodiments of the present invention which are represented in the various figures as follows:

FIG. 1 shows, in a partially cross-sectioned elevational view, a swiveling fan-jet sprinkler with a swivel drive embodying the present invention;

FIG. 2 shows a swash plate, as part of the swivel drive of the sprinkler of FIG. 1;

FIG. 3 shows a portion of the nozzle cylinder of the sprinkler of FIG. 1;

FIG. 4 is a transverse cross section through the nozzle cylinder of FIG. 3, taken along line V—V thereof;

FIGS. 5 through 7 show three different operational positions, at one-quarter turn intervals, of the swash plate and the cooperating cam follower on the nozzle cylinder of the swivel drive of FIGS. 1–4;

FIG. 8 shows a modification of the embodiment of FIGS. 1–7, featuring angle adjustment means for the swash plate of the swivel drive;

FIG. 8*a* shows the adjustment means of FIG. 8 in a side view;

DESCRIPTION OF THE PREFERRED EMBODIMENTS

Figure 10:
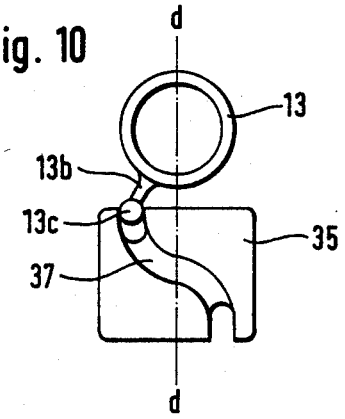
FIG. 10 shows a cam and a cam follower, as part of the swivel drive of the sprinkler of FIG. 9.

Referring to the drawings, FIGS. 1 and 10 show a swiveling lawn sprinkler of the fan-jet type, the sprinkler having a closed sprinkler housing 11 supported by a sprinkler stand 10. The housing 11 has a hose connector 12 for the supply of pressurized water to the sprinkler. In the upper part of the sprinkler housing 11 is arranged a horizontal nozzle cylinder 13 which extends outwardly from the housing 11, carrying on its exposed length portion a row of nozzle openings 42, arranged at varying angles. The water which enters the sprinkler through the hose connector 12 exits through the nozzle openings 42 in the form of a series of diverging water jets 15, forming a fantail-shaped spray pattern.

The pressurized water flowing through the sprinkler is utilized to impart to the nozzle cylinder 13 a reciprocating swiveling motion. For this purpose, the nozzle cylinder 13 is rotatably supported in the sprinkler housing 11 by means of two axially spaced swivel bearings 18 and 19. The axial position of the nozzle cylinder 13 is determined by an end face on one extremity of the nozzle cylinder 13 which abuts against a face of the swivel journal 18 (FIG. 1) and by a retaining ring 16 which forms an abutment shoulder cooperating with a sealing ring on the inside of the swivel journal 19. The exposed extremity of the nozzle cylinder 13 is capped by means of a removable cylinder cap 14.

Figure 9:
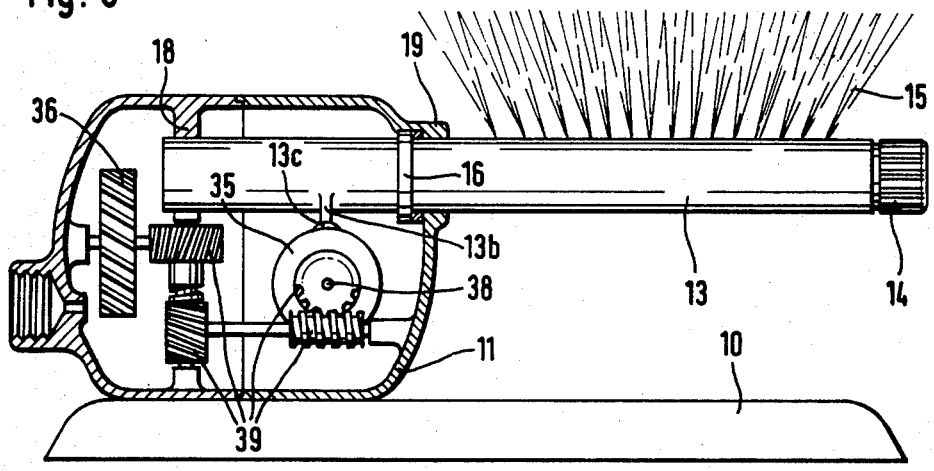
FIG. 9 shows the fan-jet sprinkler of FIG. 1 with a longitudinally cross-sectioned housing and a modified swivel drive embodying the present invention.

As can best be seen in FIG. 9, the sprinkler housing 11 accommodates a drive mechanism which utilizes the kinetic energy of the flowing pressurized water to produce the earlier-mentioned swiveling motion of the nozzle cylinder 13. For this purpose, the hose connector 12 has a nozzle-shaped inlet bore which produces a water jet. In the path of this water jet is arranged a turbine wheel 36 which is connected to a reduction gear drive 39 consisting of multiple reduction gear pairings. The turbine wheel 36 thus drives a final drive shaft 38 of the reduction gear drive which is arranged horizontally below and at right angles to the cylinder nozzle 13.

While FIG. 1 does not specifically show a turbine wheel and a reduction gear drive, it should be assumed that the same or a similar drive as shown in FIG. 9 is also used in the embodiment of FIG. 1. Both embodiments of the sprinkler have their final drive shaft 38 arranged in substantially the same relationship to the nozzle cylinder 13. They differ, however, in the mechanism which translates the rotary motion of the final drive shaft 38 into a swiveling motion of the nozzle cylinder 13. The device which accomplishes this in the embodiment of FIG. 1 is shown in FIGS. 2–7.

As can be seen in FIGS. 2 and 5, the final drive shaft 38 carries a swash plate 31 which has a torus rim 31*d* attached to a central hub 31*a* by means of two radial spokes 31*b*. The torus rim 31*d* has a peripheral outline of elliptical shape, defining a plane b—b which is inclined by a small angle $\alpha$ from a radial plane c—c through the median of the swash plate 31. The torus rim 31*d* thus forms two oppositely outwardly facing annular cam surfaces 31*c* which form a laterally undulating cam path in relation to the median radial plane c—c. The latter coincides with a plane through the londitudinal axis a—a of the nozzle cylinder 13 (FIG. 1).

Vertically above the swash plate 31, the nozzle cylinder 13 forms a follower fork 13*a* with two oppositely inwardly facing drive surfaces, as part of a radial slot in engagement with the cam surfaces 31*c* of the swash plate 31. As can be seen in FIGS. 5 through 7, the elliptical shape of the torus rim 31*d* has the result of maintaining the driving contact points between the cam surfaces 31*c* of the swash plate 31 and the drive surfaces of the follower fork 13*a* in the vicinity of the periphery of the latter. The follower fork 13*a* has the same outer shape as the nozzle cylinder 13 itself, being an integral portion of the latter in the form of an axially narrow remnant of the cylinder profile formed between two sector-shaped deep radial recesses 20 of the nozzle cylinder 13 (FIG. 3).

The elliptical peripheral shape of the swash plate 31, in addition to its simplicity, has the advantageous feature of producing a more desirable angular diaplacement pattern for the swiveling displacements of the nozzle cylinder 13, for a more even distribution of the spray within the area to be covered by the sprinkler.

FIGS. 8 and 8*a* show a modification of the drive arrangement of FIGS. 5 and 7, inasmuch as the inclination angle $\alpha$ of the swash plate 31' is made adjustable. The spokes 31*b* of FIG. 2 have been replaced with a transverse pivot shaft 43 which is seated in an enlarged portion of the final drive shaft 38' and extends in alignment with the small diameter of the ellipse of the torus rim 31*d*. The latter is centered in relation to the shaft 38' by means of two sleeves 60 (FIG. 8*a*).

Radially outside the final drive shaft 38', the swash plate 31' has a cross member 61 to which is pivotably attached an adjustment link 41 which connects the swash plate 31' to a threaded adjustment spindle 40. The latter reaches through a threaded bore of the sprinkler housing 11 from the outside thereof, thus making it possible to conveniently increase or decrease the angle $\alpha$ in a continuous fashion, thereby correspondingly increasing or decreasing the total angular swiveling displacement of the nozzle cylinder 13.

The drive arrangement of the embodiment of FIGS. 9 and 10 differs from the arrangement of the previously described embodiment, inasmuch as the swash plate 31 has been replaced with a cam cylinder 35 on the final drive shaft 38, the latter having a peripheral cam groove 37 defining two oppositely oriented cam surfaces facing each other. The cam groove 37 is of generally sinusoidal outline and symmetric in relation to the median radial plane d—d of the cam cylinder 35. Cooperating with the opposing flanks of the cam groove 37 is a follower arm 13*b* of the nozzle cylinder 13 whose extremity 13*c* has oppositely outwardly facing spherical drive surfaces which cooperate with the curved flanks of the cam groove 37.

From the foregoing, it should be understood that, as an alternative to the cam cylinder 35, it is also possible to use a swash plate with a radially open peripheral groove similar to that which is shown in FIG. 10. Such a swash plate could either have a fixed inclination, or it could be adjustable in the manner of the swash plate 31' of FIGS. 8 and 8*a*. While the nozzle cylinder 13 of the embodiments shown in the drawing is a straight cylinder, the latter could, of course, also be of the upwardly curved type, similar to some known prior art devices.

Lastly, it should be understood, that the foregoing disclosure describes only preferred embodiments of the invention and that it is intended to cover all changes and modifications of these examples of the invention which fall within the scope of the appended claims.

We claim the following:

1. In a swiveling fan-jet sprinkler which comprises a closed sprinkler housing, an elongated nozzle cylinder journalled in the housing and extending outwardly therefrom, a series of nozzle bores arranged in a fan-tail pattern on the exposed length portion of the nozzle cylinder, and a hose connector on the housing serving as an inlet for pressurized water, in such a sprinkler, a drive mechanism capable of deriving a rotary motion from the pressurized water and of translating this motion into a swiveling motion of the nozzle cylinder about its rotational axis, the sprinkler drive mechanism comprising in combination:

an inlet nozzle as part of the hose connector adapted to produce a water jet, when pressurized water enters the sprinkler housing through the hose connector;

a turbine wheel arranged inside the sprinkler housing in such a way that the water jet causes the turbine wheel to rotate;

a reduction gear drive arranged inside the sprinkler housing, said drive having its input side connected to the turbine wheel and including, on its output side, a final drive shaft with an axis which is arranged at a distance from and substantially perpendicular to the axis of the nozzle cylinder and to an axial plane through the nozzle cylinder;

a rotary cam member mounted on the final drive shaft so as to rotate therewith, the cam member being so arranged that a median position thereof is in substantial alignment with said axial plane through the nozzle cylinder axis; and a cam follower connected to the nozzle cylinder and cooperating with the cam member in such a way that the rotary motion of the cam member is translated into a reciprocating swiveling motion of the nozzle cylinder.

2. A sprinkler drive mechanism as defined in claim 1, wherein the rotary cam member has on its periphery two oppositely outwardly facing, cross-sectionally rounded annular cam surfaces; and the cam follower on the nozzle cylinder has the form of a fork with oppositely inwardly oriented drive surfaces which cooperate with said cam surfaces of the cam member.

3. A sprinkler drive mechanism as defined in claim 2, wherein the rotary cam member has the form of a swash plate with a torus-like rim of substantially circular cross-sectional shape, the rim being connected to a hub on the final drive shaft by means of spokes.

4. A sprinkler drive mechanism as defined in claim 3, wherein the torus-like rim has a substantially elliptical peripheral outline, defining a plane which is inclined in relation to a radial plane through the axis of the final drive shaft; and the fork-shaped cam follower is an integral portion of the nozzle cylinder, being formed by an axially narrow remnant of the cylinder profile between sector-shaped deep radial recesses in the nozzle cylinder.

5. A sprinkler drive mechanism as defined in claim 1, wherein the rotary cam member has on its periphery an annular groove with two substantially oppositely oriented cam surfaces facing against each other; and the cam follower on the nozzle cylinder has two oppositely outwardly facing, cross-sectionally rounded drive surfaces which cooperate with the cam surfaces of the cam member.

6. A sprinkler drive mechanism as defined in claim 5, wherein the cam member is a cam cylinder with an annular groove which defines a generally sinusoidal deviation from a radial plane through the final drive shaft.

7. A sprinkler drive mechanism as defined in any one claims 2 through 5, wherein the rotary cam member includes means for adjusting the angular extent of the swiveling motion which is imparted to the nozzle cylinder by adjusting the size of the maximum axial deviations of the annular cam surfaces of the cam member from said axial plane through the nozzle cylinder axis.

8. A sprinkler drive mechanism as defined in claim 7, wherein the cam member is in the form of a swash plate which is pivotably connected to a hub on the final drive shaft; and said adjusting means includes linkage means for changing the angle of inclination of the swash plate in relation to a radial plane through the axis of the final drive shaft.

9. A sprinkler drive mechanism as defined in claim 8, wherein the linkage means of the adjusting means includes a threaded adjustment spindle in engagement with a threaded bore of the sprinkler housing, the adjustment spindle having a length portion which extends to the outside of the housing for adjustment manipulation.

* * * * *